US008323119B2

(12) United States Patent
Ceulemans et al.

(10) Patent No.: US 8,323,119 B2
(45) Date of Patent: Dec. 4, 2012

(54) FLEXIBLE GOLFING MAT

(76) Inventors: Philippe Ceulemans, Turnhout (BE); Olivier Ceulemans, Oud-Turnhout (BE)

( * ) Notice: Subject to any disclaimer, the term of this patent is extended or adjusted under 35 U.S.C. 154(b) by 0 days.

(21) Appl. No.: 12/989,507

(22) PCT Filed: Apr. 25, 2008

(86) PCT No.: PCT/EP2008/055107

§ 371 (c)(1),
(2), (4) Date: Oct. 25, 2010

(87) PCT Pub. No.: WO2009/129863

PCT Pub. Date: Oct. 29, 2009

(65) Prior Publication Data

US 2011/0039630 A1 Feb. 17, 2011

(51) Int. Cl.
*A63B 69/36* (2006.01)

(52) U.S. Cl. ..... 473/278; 473/150

(58) Field of Classification Search ..... 473/150, 473/157, 257, 278, 279
See application file for complete search history.

(56) References Cited

U.S. PATENT DOCUMENTS

| | | | | |
|---|---|---|---|---|
| 4,913,442 | A * | 4/1990 | Walker | 473/278 |
| 4,955,611 | A * | 9/1990 | Moller | 473/262 |
| 5,308,075 | A * | 5/1994 | Theriault | 473/279 |
| 6,705,953 | B2 * | 3/2004 | Haskins | 473/278 |
| 2004/0162155 | A1 | 8/2004 | Sear | |
| 2006/0128493 | A1 | 6/2006 | Snopkowski | |

* cited by examiner

*Primary Examiner* — Nini Legesse
(74) *Attorney, Agent, or Firm* — Jerold I. Schneider; Arnstein & Lehr, LLP

(57) ABSTRACT

A tee-off golfing mat which includes an upper layer and which positions the upper layer on a distance D from a reference layer. The upper layer of the golfing mat provides a platform for teeing-off a golfing ball. At least a part of the upper layer, when exerting a force on the mat during teeing-off, is resilient in height direction of the golfing mat. The resiliency of the golfing mat is caused by magnetic forces.

10 Claims, 1 Drawing Sheet

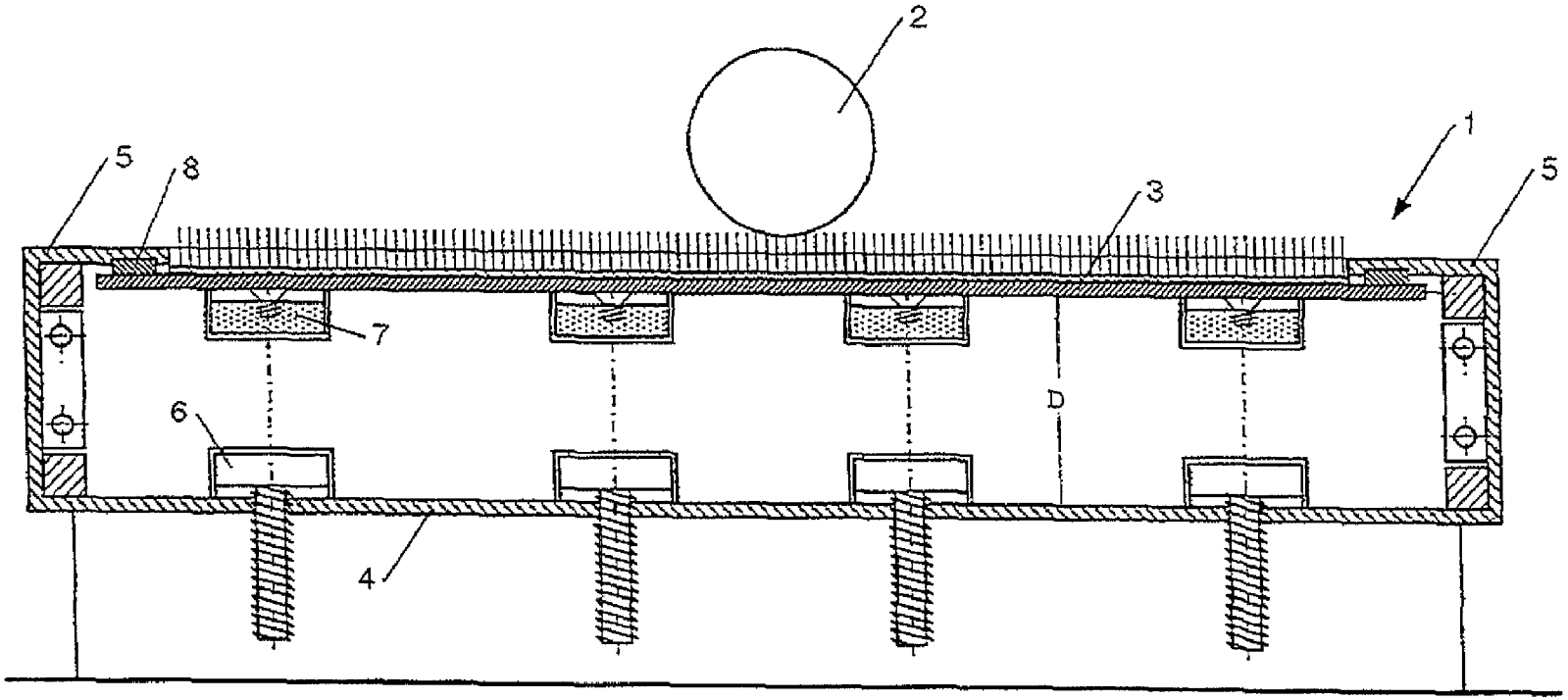
1
2
3
4
5
5
6
7
8
D

FLEXIBLE GOLFING MAT

CROSS-REFERENCE TO RELATED APPLICATIONS

This application is the §371 United States national stage entry of International Application No. PCT/EP2008/055107 filed Apr. 25, 2008, the entirety of which is hereby incorporated by reference.

BACKGROUND

The present invention relates to a golfing mat which comprises an upper layer and distance means provided for positioning the upper layer on a distance D from a reference layer, the upper layer of the golfing mat providing a platform for teeing-off a golfing ball, at least a part of the upper layer, when exerting a force on the mat during teeing-off, being resilient in height direction of the golfing mat.

Golfing mats are often used by golfers to practice teeing-off. These golfing mats lie on grass, concrete or any other ground floor surface. In particular with less skilled players who only relatively infrequently hit the ball directly and centrally, the problem is encountered that the club not only hits the ball during teeing-off, but also hits the golfing mat before or after hitting the ball. Because the teeing-off golfing mats offer only a minimal amount of damping when hitting the golfing at high speed, the club is subjected to an extreme loading which is transferred to the person holding the club. This often results in elbow, shoulder, back and knee injuries. The un-damped ground contact by the club involves a high risk to damaging of the club. Since almost the entire kinetic energy of the club is transferred to the golfing mat, a cutting-off of the upper layer of the golfing mat when the teeing-off is done incorrectly is likely to occur. As a result, golfing mats are subjected to a lot of wear and can become unusable very quickly.

In order to overcome the above mentioned problems, golfing mats have been developed which are made of a material or combination of materials that offer a certain amount of flexibility to the golfing mat. JP8193305 describes for instance a golfing mat which comprises a thin unwoven cloth applied between a layer of artificial turf and a main body, the main body comprising rubber pieces and foam particles. The layer of artificial turf forms the upper layer of the golfing mat on which the golfing ball is teed-off. The combination of these materials provides for a certain cushioning effect and for absorption of part of the kinetic energy of the club when hitting the golfing mat, thus reducing the risk to damaging clubs and players. However, the amount of cushioning provided and thus the amount of kinetic energy absorption is still too small and cannot be varied once the mat has been installed. Furthermore, when the golfing mats are used frequently, the cushioning effect of the golfing mat decreases in time.

Other golfing mats make use of elastic straps or yarns fixed to the mat to obtain the damping effect. For instance, DE-A1-3022461 describes a tee-off golfing mat with an impact absorbing layer, which comprises a spaced apart upper and lower material layer portion, which are made of single-thread or multi-thread yarn and which are connected to each other by elastic pile threads. However, each time the club hits the golfing mat, the elastic pile threads are stretched out. As a result of this and taking into account the frequent use of these mats, the elasticity of the elastic pile threads decreases quickly, resulting in fast reduction of the damping effect of the golfing mat.

The known golfing mats have the common disadvantage that their elasticity or damping property decreases quickly with time.

SUMMARY

It is an object of the present invention to provide a golfing mat with a certain elasticity, which offers a better maintenance of the elasticity over time.

This is achieved according to the present invention with a golfing mat showing the technical features of the characterizing part of the first claim.

Thereto, the tee-off golfing mat according to the present invention is characterized in that the resilient part of the golfing mat is subjected to magnetic forces for obtaining the resiliency of the golfing mat.

Magnets have two poles, a north and a south pole. Opposite poles attract, equal poles repel. Calculating the attractive or repulsive force between two magnets is in general, an extremely complex operation, as it depends on various factors such as for example the shape of the magnets, their magnetization and orientation and the distance between the magnets. The tee-off golfing mat according to the present invention makes use of magnetic forces exerted on part of the upper layer for obtaining a resilient golfing mat.

The golfing mat according to this invention comprises an upper layer and distance means provided for positioning the upper layer on a distance D from a reference layer. In rest, a ball rests on the upper surface of the upper layer of the golfing mat and exerts a force to the golfing mat which will usually correspond to the gravitational force. As a result, the vertical downward force component $F_z$ of the force exerted by the golfing ball to the upper layer of the golfing mat, can be described as:

$$F_z=(m_{ball}+m_{upper\ layer})*g$$

with $m_{ball}$: mass of the golfing ball $m_{upper\ layer}$: mass of the upper layer g: gravitational constant.

In the present invention, resiliency is implied to the flexible part of the golfing mat by the magnetic force exerted to the flexible part. In order to permit controlling the displacement of the upper layer with respect to the reference layer the vertical upward force component $F_{magn1}$ of the magnetic force exerted to the upper layer of the golfing mat is arranged such that it is equal to or larger than $F_z$, i.e:

$$F_{magn1}>F_z$$

with $F_{magn1}$ the magnetic force exerted on the upper layer on a distance D of the reference layer. As a result, in case $F_{magn1}=F_z$, the upper layer lies with at least part of its upper surface against the distance means. In case $F_{magn1}>F_z$, the upper layer is pushed with at least part of its upper surface against the distance means to make sure the distance D between the upper and reference layer of the golfing mat is maintained.

When the golfing ball is teed-off, an additional downward force is exerted on the upper layer, the magnitude of the vertical downward component of the additional force corresponding to $F_{add1}$. As a result, the vertical downward component of the total force exerted on the upper layer of the golfing mat upon teeing-off is $$F_z+F_{add1}=(m_{ball.}+m_{upper\ layer})*g+F_{add1}$$

with $F_{add1}$ being the vertical downward component of the force exerted by the club onto the golfing mat upon teeing-off.

As a result of this additional force $F_{add1}$, the upper layer of the golfing mat moves in the direction of the reference layer, as from the moment the vertical upward component of the magnetic force exerted on the upper layer $F_{magn1}$, is smaller than the sum of $F_z$, and $F_{add1}$, i.e.

$$F_{magn1}<F_z+F_{add1}$$

Because the upward magnetic force exerted on the upper layer by the reference layer increases with decreasing distance between the upper and reference layer, the magnetic force exerted on the upper layer increases during movement of the upper layer towards the reference layer. The movement of the upper layer towards the reference layer is limited to the distance where the vertical upward magnetic force exerted on the upper layer equals the vertical downward force exerted on the upper layer. This condition is for instance fulfilled when the upper layer is positioned on a distance d from the reference layer, i.e. after the upper layer has moved over a certain distance D-d towards the reference layer:

$$F_{magn2}=F_z+F_{add2}$$

with $F_{magn2}$: the magnetic force exerted to the upper layer on a distance d from the reference layer $F_{add2}$: the vertical downward force exerted on the upper layer, as a result of the teeing-off of the golfing ball, after the upper layer has moved over a distance D-d towards the reference layer.

In a final step the magnetic force $F_{magn2}$ forces the upper layer back to its original position on a distance D from the reference layer.

This process of moving the upper layer downward towards the reference layer and back up to its original position is repeated each time the golfing ball is teed-off. When exerting a force on the golfing mat by teeing-off a golfing ball, at least part of the upper layer of the golfing mat moves downwardly to the reference layer and is pushed up again, as a result of the magnetic forces exerted on that part of the upper layer of the golfing mat. The magnetic forces thus provide the golfing mat with resilient properties. Because teeing-off the golfing ball does not have any effect on the magnetic forces exerted on the golfing mat, the resilient properties of the golfing do not decrease in time.

Furthermore, the invention presents the advantage that the elasticity of the golfing mat, i.e. the amount in which the golfing mat bends upon teeing-off, is directly related to the magnitude of the magnetic forces exerted to the upper layer. The lower the magnetic forces exerted on the upper layer on a distance D from the reference layer, the higher the resilient properties of the golfing mat. Indeed, the golfing mat bends upon teeing-off as soon as the magnetic force exerted on the upper layer on a distance D from the reference layer is smaller than the sum of the weight of the upper layer with golfing ball and the additional force executed on the upper layer upon teeing-off, i.e.:

$$F_{magn1}<F_z+F_{add1}$$

This means that the lower $F_{magn1}$ is, the smaller is the force to be exerted on the upper layer upon teeing-off to provide for bending of the golfing mat. The resilient properties can thus be adjusted easily by adjusting the magnitude of the magnetic forces exerted to the upper layer.

The exact position of the resilient part of the golfing mat is not fixed and may vary depending on the specific needs of the players. Because the resiliency is caused by magnetic forces exerted on the resilient part of the golfing mat, it is sufficient to change for instance the position of the magnets causing the magnetic forces in order to change the position of the resilient part of the golfing mat. The position of the resilient parts and the amount of resiliency can even be adjusted after installment of the golfing mat or during the game.

Furthermore, because the position of the resilient part of the golfing mat can be varied easily, the lifetime of the golfing mat can be increased substantially. Indeed, in most golfing mats the golfing ball is always put on that location of the golfing mat which encounters an optimum damping effect. In most cases this position is in the center of the golfing mat. However, if time after time that same location of the golfing mat is used to tee-off the golfing ball, that specific location is subject to a lot of wear and will wear out more quickly than the other locations on the golfing mat. As a result, the golfing mat becomes unusable and has to be thrown away as soon as that specific location has worn out, even if the rest of the golfing mat is still in good condition. Because the position of the resilient part of the golfing mat according to this invention can be changed, the golfing ball can be teed-off on whatever location of the golfing mat. If a certain part of the golfing mat has worn out, the position of the magnets causing the magnetic forces can be changed such that another part of the golfing mat becomes resilient.

The reference layer can be an external layer, which does not form part of the golfing mat, for instance the ground floor. However, preferably the reference layer does form part of the golfing mat and is formed by a lower layer which is connected to the distance means. In this last case, the distance between the reference layer and the upper layer of the golfing mat is independent of the irregularities of the ground floor on which the golfing mat is installed. It further ascertains that the upper layer is set on a distance D from the reference layer along the whole length of the golfing mat.

The magnetic forces exerted on the resilient part of the golfing mat are caused by magnets which are positioned in such a way that at least part of the upper layer of the golfing mat is resilient upon teeing-off the golfing ball. These magnets can be placed on any location ought suitable by the person skilled in the art. Preferably, a first magnet is installed on the reference layer and a second magnet is installed on the upper layer. The first and/or second magnet can form an inherent part of the golfing mat or can be made detachable of the golfing mat.

BRIEF DESCRIPTION OF THE DRAWINGS

The invention is further elucidated in FIG. 1.

FIG. 1 shows a cross section of the golfing mat according to this invention in which the first and second magnets are arranged according to a regular scheme.

DETAILED DESCRIPTION

The golfing mat 1 comprises an upper layer and distance means 5 provided for positioning the upper layer 3 on a distance D from a reference layer 4.

Any distance means 5 considered suitable by the person skilled in the art can be used. The distance means 5 can for instance be made in one piece or can comprise two or more pieces which are provided on opposite sides in longitudinal direction of the golfing mat 1 as is shown in FIG. 1. The distance means 5 can have any form ought suitable by the person skilled in the art, but preferably have an L-form with an upright part being connected to the reference layer 4 and a horizontal part being provided to contact at least part of the upper layer 3 as is shown in FIG. 1.

The reference layer 4 can be an external layer, for instance the ground floor. In this case, the connection between the distance means 5 and the reference layer 4 is for instance done by pushing or hitting the upright part of the L-form into the ground, in such a way that the horizontal part of the L-form, and as a consequence the upper layer which is in contact with this horizontal part, is positioned on a distance D from the reference layer 4. If desired, holes can be provided in the ground in which the distance means 5 can be inserted. The holes can be provided with an internal thread which cooperates with an external thread on the upright part of the distance means 5. The distance means 5 can form an integral part of the reference layer 4 or can be detachably connected to the reference layer 4. By inserting the distance means 5 deeper or less deep into the ground the distance between the upper layer 3 and reference layer 4 can be varied.

Preferably, the golfing mat 1 comprises a lower layer which functions as the reference layer 4, as is shown in FIG. 1. The distance means 5 can be made in one piece with the lower layer, as is shown in FIG. 1, or the distance means 5 and the lower layer can be made in separate pieces which are connected to each other with connection means such as screws or cooperating positioning means with a complementary form, for instance a cooperating rib and groove. The lower layer can be positioned with his bottom surface on the ground. Alternatively, the lower layer can be provided with supporting means as is shown in FIG. 1. The supporting means may be inserted into the ground or be put on the ground. If desired, the supporting means can be made extendable. Alternatively, the upright part of the distance means 5 can be put in or on the ground and the lower layer may be connected to an internal face of the distance means 5. However, any other means ought suitable by the person skilled in the art may be used to connect the distance means 5 with the lower layer.

After the player has finished his game, the player can choose to only remove the upper layer 3 of the golfing mat 1, and leave the distance means 5 in the ground or leave the distance means 5 together with the lower layer and the supporting means in/on the ground. The player can also choose to remove all parts of the golfing mat 1, the distance means 5 as well as the upper layer 3 and, if applicable, the lower layer.

The magnetic forces are preferably provided for by means of at least a first 6 and a second 7 magnet, which are installed on facing surfaces of respectively the reference layer 4 and the upper layer 3 of the golfing mat 1 in opposing positions, the first 6 and second 7 magnet repelling each other.

The first 6/second 7 magnet can form an integral part of the reference 4/upper 3 layer or may be detachably connected to the reference 4/upper 3 layer. The latter case has the following advantages. First, the resiliency of the golfing mat 1 can be changed easily by changing the first 6 and/or the second 7 magnet. Second, the golfing mat 1 does not need to be thrown away if one of the magnets 6, 7 is damaged or needs to be changed. Finally, the position of the first 6/second 7 magnet can be changed such that the resilient part of the golfing mat 1 can change position.

The resiliency of the golfing mat 1 can be adjusted by changing the distance between the first 6 and second 7 magnet. The smaller the distance is between the first 6 and second 7 magnet, the more the magnets repel and the smaller the resiliency of the golfing mat 1 is.

The distance can be varied by making the first magnets 6 extendable, as is shown on FIG. 1. In FIG. 1 the first magnets 6 can be screwed upwards and downwards by means of the thread connected to the first magnets 6. However any other means can be use to move the first magnets 6 in upwards or downward direction in order to change the distance between the first 6 and second 7 magnets. In the same way, the second magnets 7 can be made extendable, or the first 6 and the second 7 magnets can be made extendable. Another possibility is that the reference/lower layer 4 is moved upward and downward, in order to change the position between the first 6 and second 7 magnets. This is in particular possible in case the lower layer is connected to opposing inner faces of the distance means 5 and the distance means 5 are put in/on the ground floor or the lower layer is connected through supporting means in/on the ground floor. By varying the position of the lower layer with respect to the upper 3 layer, the distance between the first 6 and second 7 magnets may be varied.

The resiliency of the golfing mat 1 can be adjusted by changing the magnitude of the magnetic field of the first 6 and/or second 7 magnet. The higher the magnitude of the first 6 and/or second 7 magnet is, the more the magnets repel and the smaller the resiliency of the golfing mat 1 is.

In case use is made of permanent magnets, i.e. magnets with a fixed magnetic field, the resiliency of the golfing mat can be adjusted by replacing the first 6 and/or second 7 magnet by one or two other magnets with a different magnitude of the magnetic field. Replacing the first 6 and/or second 7 magnets with one or two other magnets is in particular easy when the first 6 and/or second 7 magnets are detachably installed on the reference 4/upper 3 layer of the golfing mat 1. Another possibility is that use is made of non-permanent magnets, i.e. magnets with an adjustable magnitude of the magnetic field.

The golfing mat 1 preferably comprises a plurality of opposing magnets which are fitted to facing surfaces of the reference layer 4 and the upper layer 3 of the golfing mat 1. In this way the golfing mat 1 can comprise different resilient parts. The resiliency of the different parts may be varied. A more resilient part can for instance be provided in the center of the golfing mat 1 and less resilient parts can be provided at the edges of the golfing mat 1. This can be done in any way ought suitable by the person skilled in the art. This can for instance be done by providing a larger amount of first 6 and second 7 magnets in the center of the golfing mat 7 and a smaller amount at the edges. Another possibility is to provide the center of the golfing mat with a first 6 and/or second 7 magnet with a larger magnitude of the magnetic field as compared to the first 6 and/or second 7 magnets provided at the edges of the golfing mat 1. The magnets can be arranged in a random way or according to a regular scheme and can control the position of the resilient parts of the golfing mat 1.

Since it is not the material of the upper layer 3 that gives the golfing mat 1 its resiliency, the type of material is not of particular importance to the functioning of the golfing mat 1. As a result, any material ought suitable by the person skilled in the art can be used for the upper layer 3. Preferably, the upper layer 3 of the golfing mat 1 is made of a plastic material, since such a material provides in a high resistance against weathering.

When teeing-off the golfing ball, the upper layer 3 of the golfing mat 1 moves towards the reference layer 4 and is then forced back to the distance means 5. In order to avoid damage of the distance means 5, a layer of a flexible material 8 is preferably provided between the upper layer of the golfing mat and the distance means 5 for damping the movement of the upper layer 3 towards the distance means 5. This is for instance shown in FIG. 1.

The invention claimed is:

1. A tee-off golfing mat which comprises an upper layer and distance means provided for positioning the upper layer on a distance D from a reference layer, the upper layer of the golfing mat providing a platform for teeing-off a golfing ball, at least a part of the upper layer, when exerting a force on the mat during teeing-off, being resilient in height direction of the golfing mat, wherein the resilient part of the golfing mat is subjected to magnetic forces for obtaining the resiliency of the golfing mat, characterised in that the magnetic forces are provided for by means of at least a first and second magnet, which are installed on facing surfaces of respectively the reference layer and the upper layer of the golfing mat in opposing positions, the first and second magnet repelling each other.

2. The golfing mat according to claim 1, characterized in that the tee-off golfing mat comprises a lower layer which functions as the reference layer and which is connected to the distance means.

3. The golfing mat according to claim 1, characterized in that the distance between the at least first and second magnet is adjustable.

4. The golfing mat according to claim 1, characterized in that the magnetic field of the at least first and/or second magnet has an adjustable magnitude.

5. The golfing mat according to claim 1, characterized in that the at least first and second magnet are permanent magnets.

6. The golfing mat according to claim 1, characterized in that a plurality of opposing magnets is installed on facing surfaces of the reference layer and the upper layer of the golfing mat according to a regular scheme.

7. The golfing mat according to claim 1, characterized in that a plurality of opposing magnets is installed on facing surfaces of the reference layer and the upper layer of the golfing mat in a random way.

8. The golfing mat according to claim 1, characterized in that the upper layer of the golfing mat is made of a plastic material.

9. A golfing mat according to claim 1, characterized in that a layer of a flexible material is provided between the upper layer of the golfing mat and the distance means for amping the movement of the upper layer versus the distance means.

10. A golfing mat according to claim 1, characterized in that a layer of a flexible material is provided between the upper layer of the golfing mat and the distance means for damping the movement of the upper layer versus the distance means.

* * * * *